US009579724B2

(12) United States Patent
Sun

(10) Patent No.: US 9,579,724 B2
(45) Date of Patent: Feb. 28, 2017

(54) METHOD FOR PRODUCING NEODYMIUM-IRON-BORON RARE EARTH PERMANENT MAGNETIC DEVICE

(71) Applicant: China North Magnetic & Electronic Technology Co., LTD, Shenyang, Liaoning (CN)

(72) Inventor: Haotian Sun, Liaoning (CN)

(73) Assignee: China North Magnetic & Electronic Technology Co., LTD., Shenyang, Liaoning Province (CN)

( * ) Notice: Subject to any disclaimer, the term of this patent is extended or adjusted under 35 U.S.C. 154(b) by 813 days.

(21) Appl. No.: 14/040,712

(22) Filed: Sep. 29, 2013

(65) Prior Publication Data

US 2015/0248968 A1 Sep. 3, 2015

(30) Foreign Application Priority Data

May 5, 2013 (CN) ..... 2013 1 0160603

(51) Int. Cl.

| | |
|---|---|
| ***B22F 3/12*** | (2006.01) |
| ***B22F 9/04*** | (2006.01) |
| ***H01F 1/057*** | (2006.01) |
| ***B22F 3/24*** | (2006.01) |
| ***H01F 41/02*** | (2006.01) |
| ***C22C 38/00*** | (2006.01) |

(52) U.S. Cl.

CPC ..... *B22F 9/04* (2013.01); *B22F 3/24* (2013.01); *C22C 38/00* (2013.01); *H01F 1/0577* (2013.01); *H01F 41/0273* (2013.01); *B22F 2003/248* (2013.01); *B22F 2998/10* (2013.01); *B22F 2999/00* (2013.01)

(58) Field of Classification Search

CPC .. H01F 1/0575–1/0577; H01F 41/0253; H01F 41/0266; B22F 3/12; B22F 3/24; B22F 9/04; B22F 2009/044

See application file for complete search history.

(56) References Cited

U.S. PATENT DOCUMENTS

| | | | |
|---|---|---|---|
| 6,461,565 | B2 | 10/2002 | Tokuhara et al. |
| 6,491,765 | B2 | 12/2002 | Okayama et al. |
| 6,527,874 | B2 | 3/2003 | Li |
| 6,537,385 | B2 | 3/2003 | Okayama et al. |

FOREIGN PATENT DOCUMENTS

| | | | |
|---|---|---|---|
| CN | 1182548 | | 12/2004 |
| CN | 1195600 | | 4/2005 |
| CN | 1272809 | | 8/2006 |
| CN | 102568806 A | * | 7/2012 |

* cited by examiner

*Primary Examiner* — Jessee Roe
*Assistant Examiner* — Anthony Liang

(57) ABSTRACT

A method for producing neodymium-iron-boron rare earth permanent magnetic materials mainly comprises processes of: alloy smelting, coarsely pulverization, milling, magnetic compaction, sintering, machining, vacuum heat treatment, and etc. Magnetic performance of permanent magnetic devices is increased by improving technologies of hydrogen pulverization, milling by jet mill, and vacuum heat treatment, in such a manner that usage amount of rare earth is decreased. The present invention is applicable in producing rare earth permanent magnetic materials having high performance.

9 Claims, No Drawings

METHOD FOR PRODUCING NEODYMIUM-IRON-BORON RARE EARTH PERMANENT MAGNETIC DEVICE

BACKGROUND OF THE PRESENT INVENTION

Field of Invention

The present invention relates to a field of permanent magnetic device, and more particularly to a method for producing a neodymium-iron-boron rare earth permanent magnetic device having a high performance.

Description of Related Arts

Neodymium-iron-boron rare earth permanent magnetic materials are widely applied in the nuclear magnetic resonance imaging of medical industry, hard disk drivers of computers, loudspeaker boxes, mobiles, etc., because of its excellent magnetic property. To meet the requirements of energy-saving and the low carbon economy, the neodymium-iron-boron rare earth permanent magnetic materials are applied in fields of auto parts, household appliances, energy-saving and controlling motors, hybrid electric vehicles, wind power generation, etc.

In 1982, Japan Sumitomo Special Metals Co. firstly published Japanese patents about the neodymium-iron-boron rare earth permanent magnetic materials, i.e., JP1,622,492 and JP2,137,496, and then Japan Sumitomo Special Metals Co. applied for United States patents and European patents. The characteristic, ingredients, and producing method of the neodymium-iron-boron rare earth permanent magnetic materials were disclosed. The main phase is Nd2Fe14B phase, and the grain boundary phases are Nd-rich phase, B-rich phase, and impurities comprising rare earth oxides.

On Apr. 1, 2007, Japan Hitachi Metals Co. was merged with Japan Sumitomo Special Metals Co., and took up the rights and obligations of the patent licenses of the neodymium-iron-boron rare earth permanent magnetic materials of Japan Sumitomo Special Metals Co. On Aug. 17, 2012, Japan Hitachi Metals Co. submitted a case to United States International Trade Commission (ITC), based on the fact that Japan Hitachi Metals Co. owns the U.S. Pat. No. 6,461,565, U.S. Pat. No. 6,491,765, U.S. Pat. No. 6,537,385, and U.S. Pat. No. 6,527,874 applied in United States.

SUMMARY OF THE PRESENT INVENTION

With expanding of application market of neodymium-iron-boron rare earth permanent magnetic materials, a problem of shortage of rare earth resources becomes more and more serious. Especially in fields of electronic components, energy-saving and controlling motors, auto parts, new energy automobiles, wind power, etc., more heavy rare earth is required to increase coercivity. Therefore, how to reduce a usage amount of the rare earth, especially the usage amount of the heavy rare earth, is an important topic in front of us. After exploration, we develop a method for producing a neodymium-iron-boron rare earth permanent magnetic device having a high performance.

The present invention is realized by a following technical solution.

A neodymium-iron-boron rare earth permanent magnetic device, has alloy comprising R, Fe, B, and M, wherein R refers to one or a more rare earth elements, Fe refers to element Fe, B refers to element B, M refers to one or more elements selected from the element group consisting of Al, Co, Nb, Ga, Zr, Cu, V, Ti, Cr, Ni, and Hf. The method for producing the neodymium-iron-boron rare earth permanent magnetic device is as follows.

1. Alloy Smelting Process

Smelting method of the alloys comprises an ingot casting process, which comprises heating raw materials of the neodymium-iron-boron rare earth permanent magnetic alloy to be an alloy in a molten state under a condition of vacuum or protective atmosphere; and then pouring the alloy in the molten state into a water-cooled mould under the condition of vacuum or protective atmosphere to form an alloy ingot. Preferably, the ingot casting process comprises moving or rotating a mould while pouring, in such a manner that an ingot thickness is 1~20 mm. Preferably, an alloy smelting method comprises a strip casting process, which comprises heating and melting an alloy, and pouring the molten alloy on a rotating roller with a water cooling device via a tundish, wherein the molten alloy becomes an alloy slice after cooled by the rotating roller, a cooling speed of the rotating roller is 100-1000° C./S, and a temperature of the cooled alloy slice is 550-400° C. Preferably, the alloy smelting method comprises cooling the alloy slice again by collecting the alloy slice with a rotating cylinder after the alloy slice leaves a rotating copper roller. Preferably, the alloy smelting method comprises cooling the alloy slice again by collecting the alloy slice with a turntable after the alloy slice leaves a rotating copper roller, wherein the turntable is below the copper roller, and an inert gas cooling device with a heat exchanger and a mechanical stirring device are provided above the turntable. Preferably, the alloy smelting method comprises preserving heat of the alloy slice by a secondary cooling device after the alloy slice leaves the rotating copper roller and before the alloy slice is cooled again, wherein a period of heat preserving is 10~120 min, and a temperature of heat preserving is 550~400° C.

2. Coarsely Pulverization Process

Coarsely pulverizing method of the alloy mainly comprises two methods, i.e., mechanical pulverization and hydrogen pulverization. The mechanical pulverization comprises pulverizing the alloy ingot smelted into particles having a grain diameter less than 5 mm with a pulverizing equipment, such as jaw crusher, hammer crusher, ball mill, rod mill, and disc mill, under a protection of nitrogen. Generally, the alloy slice is not pulverized by the jaw crusher and the hammer crusher. Coarse particles obtained by a previous process are directly milled into fine particles having a grain diameter less than 5 mm by the pulverizing equipment, such as the ball mill, the rod mill, and the disc mill under the protection of nitrogen. Another producing method of this process is hydrogen pulverization, which comprises: feeding the alloy slice or the alloy ingot obtained by the previous process into a vacuum hydrogen pulverization furnace, which is evacuated and filled with hydrogen, in such a manner that the alloy in the vacuum hydrogen pulverization furnace absorbs the hydrogen, wherein a temperature of hydrogen adsorption is usually less than 200° C., and a pressure of hydrogen adsorption is usually 50~200 KPa; after absorbing the hydrogen, evacuating the vacuum hydrogen pulverization furnace again and heating to dehydrogenate the alloy, wherein a temperature of dehydrogenation is usually 600~900° C.; and cooling the particles after dehydrogenation, under the condition of vacuum or protective atmosphere, wherein the protective atmosphere is embodied as an argon protective atmosphere.

Preferably, the hydrogen pulverization comprises: feeding the alloy ingot or the alloy slice into the rotating cylinder, which is evacuated and then filled with hydrogen, in such a manner that the alloy absorbs the hydrogen; stopping filling the rotating cylinder with hydrogen until the alloy is saturated with hydrogen; keeping the state for more than 10 minutes; evacuating the rotating cylinder, then heating the alloy while rotating the rotating cylinder to dehydrogenate the alloy under the condition of vacuum, wherein the temperature of dehydrogenation is usually 600~900° C.; and cooling the rotating cylinder after dehydrogenation.

Preferably, the hydrogen pulverization relates to a continuous producing method of rare earth permanent magnetic alloy and its equipment. The equipment comprises a hydrogen adsorption chamber, a heating dehydrogenation chamber, a cooling chamber, chamber-isolating valves, a charging basket, a transmission device, a evacuating device; wherein the hydrogen adsorption chamber, the heating dehydrogenation chamber and the cooling chamber are respectively connected via the chamber-isolating valves, the transmission device is provided in upper portions of the hydrogen adsorption chamber, the heating dehydrogenation chamber and the cooling chamber, the charging basket is hanged on the transmission device, materials in the charging basket is transported to the hydrogen adsorption chamber, the heating dehydrogenation chamber and the cooling chamber in turn along the transmission device. When the equipment is working, the alloy is fed in a charging basket hanged on the transmission device, and the charging basket carrying the alloy is transported to the hydrogen adsorption chamber, the heating dehydrogenation chamber and the cooling chamber in turn, in such a manner that the alloy is processed with hydrogen adsorption, heating and dehydrogenation, and cooling in turn. A number of the hydrogen adsorption chamber is one or more. A number of the heating dehydrogenation chamber is one or more. Then the alloy is stored in a storage drum under the condition of vacuum or protective atmosphere.

3. Milling Process

A method for producing alloy powder comprises milling by a jet mill. The jet mill comprises: a feeder; a milling chamber, wherein a nozzle is provided in a lower portion thereof, and a sorting wheel is provided in an upper portion thereof; a weighing system for controlling a powder weight and a feeding speed in the milling chamber; a cyclone collector; a powder filter; and a gas compressor. The working gas is embodied as nitrogen, and a pressure of compressed gas is 0.6~0.8 MPa. When the jet mill is working, the powder obtained by the previous process is fed into the feeder of the jet mill firstly. The powder is added into the milling chamber under controlling of the weighing system. The powder is grinded by high-speed airflow sprayed by the nozzle. The powder grinded rises with the airflow. The powder meeting a milling requirement enters into the cyclone collector to be collected via the sorting wheel, and the coarse powder not meeting the milling requirement goes back to the lower portion of the milling chamber, under an effect of centrifugal force, to be grinded again. The powder entering into the cyclone collector is collected in a material collector in a lower portion of the cyclone collector as a finished product. Because the cyclone collector cannot collect all of the powder, a few fine powder is discharged with the airflow. This part of fine powder is filtered by the powder filter, and collected in a fine powder collector provided in a lower portion of the powder filter. Generally, a weight ratio between the fine powder and the whole powder is less than 15%, and a grain diameter of the fine powder is less than 1 μm. This part of powder has a rare earth concentration higher than an average rare earth concentration of the whole powder, so this part of powder is easy to be oxygenated, and is thrown away as waste powder. Preferably, a part of fine power in the atmosphere having an oxygen content less than 50 ppm and the powder collected by the cyclone collector are added into a two-dimensional or three-dimensional mixing machine to mix with each other, and be compacted into compacts in a magnetic field under the protective atmosphere. A mixing period is generally more than 30 minutes, and the oxygen content in the atmosphere is less than 50 ppm. Preferably, a fine powder collector is provided between the cyclone collector and the powder filter. The cyclone collector collects the fine powder discharged with the airflow, and 10% of the fine powder can generally be collected. This part of fine powder and the powder collected by the cyclone collector are added into the two-dimensional or three-dimensional mixing machine to mix with each other, and be compacted into compacts in the magnetic field under the protective atmosphere. Because of having a high concentration of rare earth, the fine powder is very suitable to be used as a rare-earth-rich phase in crystal boundaries, in such a manner that a magnetic performance is increased. To increase the magnetic performance, preferably, alloys of various compositions are respectively smelted, and the alloys are respectively milled into powders. Then the powders are mixed, and compacted into compacts in the magnetic field.

4. Compaction Process

Compaction of neodymium-iron-boron rare earth permanent magnets is most different from compaction of common powder metallurgy in compaction under an oriented magnetic field, so an electromagnet is provided on a press. Because neodymium-iron-boron rare earth permanent magnetic powder tends to be oxygenated, some patents proposed that an environmental temperature while compaction is controlled between 5° C. and 35° C., a relative humidity is 40%-65%, and an oxygen content is 0.02-5%. To prevent the powder from being oxygenated, preferably, a compacting equipment comprises a protecting box, wherein gloves are provided on the protecting box, and the powder is processed with magnetic compaction under a protective atmosphere. Preferably, a cooling system is provided in a magnetic space in the protecting box, and a temperature of a magnetic compaction space can be controlled. Moulds are displaced in a microthermal space whose temperature can be controlled. The powder is compacted into compacts in a controlled temperature, and the temperature is controlled between −15° C. and 20° C. Preferably, the compacting temperature is less than 5° C. An oxygen content in the protecting box is less than 200 ppm, preferably, 150 ppm. An oriented magnetic field intensity in a chamber of the mould is generally 1.5-3T. The magnetic field is oriented in advance before magnetic powder is compacted into compacts, and the oriented magnetic field intensity remains unchanged while compaction. The oriented magnetic is embodied as a constant magnetic field, or a pulsating magnetic field, i.e., an alternating magnetic field. To decrease a compacting pressure, isostatic pressing is processed after the magnetic compaction, and then the material is fed into a sintering furnace to be sintered after the isostatic pressing.

5. Sintering Process

The sintering process is after the compaction process. The sintering process is finished in a vacuum sintering furnace, and under the condition of vacuum or protective atmosphere. A protective gas is embodied as argon. A sintering temperature is 1000-1200° C. A heat preservation period is generally 0.5-20 hours. Argon or nitrogen is used to cool the material after heat preservation. Preferably, a sintering equipment comprises a valve and a transferring box with gloves provided in front of the vacuum sintering furnace. The compacts after being compacted are transported into the transferring box under the condition of protective atmosphere. The transferring box is filled with the protective gas. Under the condition of protective atmosphere, outer packings of the compacts are removed, and the compacts are fed into a sintering charging box. Then the valve between the transferring box and the sintering furnace is opened. The sintering charging box carrying the compacts is transported into the vacuum sintering furnace to be sintered by a transport mechanism in the transferring box. Preferably, a multi-chamber vacuum sintering furnace is used for sintering. Degasification, sintering, and cooling are respectively finished in different vacuum chambers. The transferring box with gloves is connected with the vacuum chambers via the valve. The sintering charging box passes through the vacuum chambers in turn. To increase the coercivity of magnets, the compacts are processed with aging process once or twice after sintering. An aging temperature of a first aging process is generally 400-700° C. A higher temperature of a second aging process is generally 800-1000° C., and a lower temperature of the second aging process is 400-700° C. The compacts are processed with machining and surface treatment after aging.

Vacuum heat treatment technology of the present invention is as follows.

The compacts are processed with machining into parts after sintering, according to a final size and shape of the rare earth permanent magnetic device or an approximate final size and shape of the rare earth permanent magnetic device. After machining, the parts are processed with oil removing, washing, and drying. Then the parts machined are placed into a charging box made of a material applicable for the vacuum heat treatment, such as metal, graphite and ceramic. One charging box can carry one or more parts, and metal nets or metal plates are provided between the parts, and between the parts and the charging box, to separate the parts, and the parts and the charging box. Materials comprising rare earth are provided in the charging box. Then a cover of the charging box is closed, and the charging box is fed into a vacuum heat treatment furnace to be processed with the vacuum heat treatment. Vacuum degree of the vacuum heat treatment is $5\sim5\times10^{-4}$ Pa. A temperature of heat preservation is 800~1000° C. A period of heat preservation is 2~20 hours. The charging box is cooled with argon after heat preservation. Then the temperature is increased to 450-650° C. after cooling. After preserving heat for 0.5~12 hours, the charging box is cooled with argon again. The vacuum heat treatment furnace carries one charging box or a plurality of charging boxes. The vacuum heat treatment furnace comprises one chamber, two chambers, three chambers, or more chambers. After the charging box is fed into the vacuum heat treatment furnace, the vacuum heat treatment furnace is evacuated. The charging box is heated, heat-preserved, and then cooled under the condition of vacuum once or more times. The parts are selectively processed with post processes, such as grinding, chamfering, sandblasting, electroplating, electrophoresis, spraying, and vacuum coating, to meet requirements of the parts, such as size, accuracy, and corrosion resistance.

The present invention is applicable in producing rare earth permanent magnetic materials of high performance. The vacuum heat treatment technology is improved to significantly increase coercivity of rare earth permanent magnet, when heavy rare earth content is equal, in such a manner that usage amount of heavy rare earth is saved, and scarce resources are protected.

These and other objectives, features, and advantages of the present invention will become apparent from the following detailed description, the accompanying drawings, and the appended claims.

DETAILED DESCRIPTION OF THE PREFERRED EMBODIMENT

The embodiments are described as follows to further illustrate remarkable effects of the present invention.

Embodiment 1

600 kg of alloy A, B, C, or D is taken to be smelted, and composition of the alloy is listed in Table 1. The alloy in a molten state is poured on a rotating cooling roller with a water cooling device to be cooled and form an alloy slice. Then the alloy slice is coarsely pulverized by a vacuum hydrogen pulverization furnace. The alloy is processed with a jet mill after hydrogen pulverization. An oxygen content in atmosphere of the jet mill is less than 50 ppm. Powder collected by a cyclone collector and fine powder collected by a fine powder collector are mixed by a two-dimensional mixing machine for 60 minutes under protection of nitrogen, and then fed into a pressing machine with an oriental magnetic field and the protection of nitrogen to be compacted into compacts. An oxygen content in a protecting box is 150 ppm. An intensity of the oriental field is 1.8T. A temperature in a chamber of a mould is 3° C. Each of the compacts has a size of 62×52×42 mm. A direction of an oriented magnetic field is embodied as a direction of a height, i.e. 42 mm. The compacts are packaged in the protecting box after compaction. The compacts are taken out from the protecting box, and processed with isostatic pressing, and pressure of the isostatic pressing is 200 MPa. Then the compacts are transported into a vacuum sintering furnace to be sintered, and sintering temperature is 1060° C. The compacts are processed with argon circulation cooling, until a temperature of the compacts is 80° C. Then the compacts are processed with machining, wherein the compacts are processed into four types of parts, i.e., bigger square slice (60×25×10), smaller square slice (30×20×3), sector (R30×r40, radian 60°, thickness 5), and concentric tile (R60×r55, chord length 20, height 30). After the parts are processed with oil removing, washing, and drying, the parts are placed into a charging box made of a material applicable for vacuum heat treatment, such as metal, graphite and ceramic, and a cover of the charging box is closed. Numbers of the parts carried by the charging box are shown in Table 2. Metal nets are provided between the parts, and between the parts and the charging box, to separate the parts, and the parts and the charging box. The charging box is fed into a vacuum heat treatment furnace to be processed with the vacuum heat treatment by a skip car able to move. Vacuum degree of the vacuum heat treatment is $5\times10^{-2}$ Pa. A temperature of heat preservation is 850° C. After heat-preserving for 10 hours, the charging box is cooled with argon to a temperature of 100° C. Then the temperature is increased to 480° C. After preserving heat for 4 hours, the charging box is cooled with argon to a temperature of 80° C. Finally, the charging box is taken out of the furnace.

The parts are selectively processed with post processes, such as grinding, chamfering, sandblasting, electroplating, electrophoresis, spraying, and vacuum coating, to meet requirements of the parts, such as size, accuracy, and corrosion resistance. Testing results of magnetic performance are shown in Table 2.

TABLE 1

| Composition of alloy | | |
|---|---|---|
| Num. | Code | Composition |
| 1 | A | Nd30Dy1Fe67.9B0.9Al0.2 |
| 2 | B | Nd30Dy1Fe67.5Co1.2Cu0.1B0.9Al0.1 |
| 3 | C | (Pr0.2Nd0.8)25Dy5Fe67.4Co1.2Cu0.3B0.9Al0.2 |
| 4 | D | (Pr0.2Nd0.8)25Dy5Tb1Fe65Co2.4Cu0.3 B 0.9Al0.2Ga0.1Zr0.1 |

TABLE 2

Measuring results of magnetic performance of special heat treatment

| Num. | Code | Size and shape | Number of part (piece/box) | Surface treatment | Magnetic energy product (MGOe) | Remanence (Gs) | Coercivity (Oe) |
|---|---|---|---|---|---|---|---|
| 1 | A | Bigger square slice | 180 | Electroplating | 47.7 | 13980 | 17994 |
| 2 | A | Smaller square slice | 500 | Electrophoresis | 47.4 | 13910 | 17699 |
| 3 | A | Sector | 400 | Parkerising | 47.9 | 13973 | 17551 |
| 4 | A | Concentric tile | 300 | Spray coating | 47.7 | 13976 | 17787 |
| 5 | B | Bigger square slice | 180 | Electroplating | 47.8 | 13971 | 17849 |
| 6 | B | Smaller square slice | 500 | Electrophoresis | 48.2 | 13998 | 17606 |
| 7 | B | Sector | 400 | Parkerising | 48.0 | 13985 | 17630 |
| 8 | B | Concentric tile | 300 | Spray coating | 48.1 | 14004 | 17987 |
| 9 | C | Bigger square slice | 180 | Electroplating | 39.2 | 12590 | 28600 |
| 10 | C | Smaller square slice | 500 | Electrophoresis | 39.1 | 12560 | 29200 |
| 11 | C | Sector | 400 | Parkerising | 39.0 | 12550 | 28700 |
| 12 | C | Concentric tile | 300 | Spray coating | 39.2 | 12580 | 28600 |
| 13 | D | Bigger square slice | 180 | Electroplating | 38.4 | 12600 | 28800 |
| 14 | D | Smaller square slice | 500 | Electrophoresis | 38.2 | 12580 | 29200 |
| 15 | D | Sector | 400 | Parkerising | 38.4 | 12620 | 28900 |
| 16 | D | Concentric tile | 300 | Spray coating | 38.3 | 12590 | 28800 |

Embodiment 2

600 kg of the alloy A, B, C, or D is taken to be smelted, and composition of the alloy is listed in Table 1. The alloy is processed with casting to form an ingot having a thickness of 12 mm. Hydrogen pulverization comprises feeding the ingot into a hydrogen-absorbing pot, which is evacuated and then filled with hydrogen. The ingot absorbs the hydrogen. Filling the rotating cylinder with hydrogen is stopped, after the alloy slice is saturated with hydrogen. Then the alloy, which has absorbed hydrogen, is fed into a rotating vacuum heat treatment equipment to be dehydrogenated under a condition of vacuum. The alloy is cooled by argon after dehydrogenation. Other processes are same as embodiment 1. Results are shown in Table 3.

TABLE 3

Measuring results of magnetic performance of special heat treatment

| Num. | Code | Size and shape | Number of part (piece/box) | Surface treatment | Magnetic energy product (MGOe) | Remanence (Gs) | Coercivity (Oe) |
|---|---|---|---|---|---|---|---|
| 1 | A | Bigger square slice | 180 | Electroplating | 47.6 | 13972 | 17490 |
| 2 | A | Smaller square slice | 500 | Electrophoresis | 47.3 | 13907 | 17195 |
| 3 | A | Sector | 400 | Parkerising | 47.6 | 13965 | 17050 |
| 4 | A | Concentric tile | 300 | Spray coating | 47.2 | 13967 | 17285 |
| 5 | B | Bigger square slice | 180 | Electroplating | 47.7 | 13960 | 17344 |
| 6 | B | Smaller square slice | 500 | Electrophoresis | 48.2 | 13988 | 17105 |
| 7 | B | Sector | 400 | Parkerising | 47.5 | 13972 | 17131 |
| 8 | B | Concentric tile | 300 | Spray coating | 48.4 | 14001 | 17483 |
| 9 | E | Bigger square slice | 180 | Electroplating | 39.4 | 12581 | 28502 |
| 10 | E | Smaller square slice | 500 | Electrophoresis | 39.3 | 12552 | 28701 |
| 11 | E | Sector | 400 | Parkerising | 38.8 | 12540 | 28201 |
| 12 | E | Concentric tile | 300 | Spray coating | 39.1 | 12570 | 28102 |

TABLE 3-continued

Measuring results of magnetic performance of special heat treatment

| Num. | Code | Size and shape | Number of part (piece/box) | Surface treatment | Magnetic energy product (MGOe) | Remanence (Gs) | Coercivity (Oe) |
|---|---|---|---|---|---|---|---|
| 13 | F | Bigger square slice | 180 | Electroplating | 38.4 | 12592 | 28301 |
| 14 | F | Smaller square slice | 500 | Electrophoresis | 38.3 | 12573 | 28703 |
| 15 | F | Sector | 400 | Parkerising | 38.7 | 12613 | 28402 |
| 16 | F | Concentric tile | 300 | Spray coating | 38.3 | 12585 | 28800 |

Comparison Example 1

600 kg of the alloy A, B, C, or D is taken to be smelted, and composition of the alloy is listed in Table 1. The alloy is processed with casting to form an ingot having a thickness of 12 mm. The alloy is processed with a jet mill after hydrogen pulverization. An oxygen content in atmosphere of the jet mill is less than 30 ppm. Powder collected by a cyclone collector and fine powder collected by a fine powder collector are mixed by a two-dimensional mixing machine for 30 minutes under protection of nitrogen, and then fed into a pressing machine with an oriental magnetic field and the protection of nitrogen to be compacted into compacts. An oxygen content in a protecting box is 150 ppm. An intensity of the oriental field is 1.8T. A temperature in a chamber of a mould is 3° C. Each of the compacts has a size of 62×52×42 mm. A direction of an oriented magnetic field is embodied as a direction of a height, i.e. 42 mm. The compacts are packaged in the protecting box after compaction. The compacts are taken out from the protecting box, and processed with isostatic pressing, and pressure of the isostatic pressing is 200 MPa. Then the compacts are transported into a vacuum sintering furnace to be sintered, and sintering temperature is 1060° C. The compacts are processed with aging treatment twice. Aging temperatures are respectively 850° C. and 580° C. Measuring results of magnetic performance are shown in Table 4.

TABLE 4

Measuring results of magnet magnetic performance of ingot

| Num. | Code | Weight of power (Kg) | Weight of fine powder (Kg) | Weight of fine power added (Kg) | Magnetic energy product (MGOe) | Remanence (Gs) | Coercivity (Oe) |
|---|---|---|---|---|---|---|---|
| 1 | A | 530 | 40 | 40 | 47.3 | 13965 | 14563 |
| 2 | B | 535 | 35 | 35 | 46.9 | 14000 | 14400 |
| 3 | C | 540 | 30 | 30 | 37.5 | 12390 | 25320 |
| 4 | D | 540 | 30 | 30 | 37.7 | 12560 | 26500 |

Comparison Example 2

600 kg of the alloy A, B, C, or D is taken to be smelted, and composition of the alloy is listed in Table 1. The alloy in a molten state is poured on the rotating cooling roller with the water cooling device to be cooled and form an alloy slice. Then the alloy slice is coarsely pulverized by the vacuum hydrogen pulverization furnace. The alloy is processed with the jet mill after hydrogen pulverization. Follow-up processes are same as comparison example 1. Measuring results of magnetic performance are shown in Table 5.

TABLE 5

Measuring results of magnetic performance of rapidly solidified alloy

| Num. | Code | Weight of power (Kg) | Weight of fine powder (Kg) | Weight of fine power added (Kg) | Magnetic energy product (MGOe) | Remanence (Gs) | Coercivity (Oe) |
|---|---|---|---|---|---|---|---|
| 1 | A | 535 | 35 | 40 | 48.0 | 14112 | 15563 |
| 2 | B | 545 | 30 | 35 | 47.7 | 14180 | 15500 |
| 3 | C | 545 | 30 | 30 | 38.0 | 12540 | 26230 |
| 4 | D | 545 | 30 | 30 | 38.6 | 12680 | 27800 |

The above embodiment 1, 2 are compared with the comparison example 1, 2. It is found that the coercivity of products obtained according to the present invention is significantly higher than the coercivity of products in the comparison examples. The coercivity of the alloy slice obtained according the present invention is higher than the coercivity of the ingot obtained according the present invention. The present invention is applicable in producing rare earth permanent magnetic materials having high performance.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method for producing a neodymium-iron-boron rare earth permanent magnetic device, comprising steps of:

firstly smelting raw materials of neodymium-iron-boron rare earth permanent magnetic alloy to be an alloy under a condition of vacuum or protective atmosphere;

after hydrogen pulverization and milling, pressing and compacting the alloy into compacts in an oriented magnetic field;

sintering the compacts;

processing the compacts with machining after sintering, according to a final size and shape of the rare earth permanent magnetic device or an approximate final size and shape of the rare earth permanent magnetic device;

placing the machined compacts into a charging box made of a material applicable for vacuum heat treatment, comprising one of metal, graphite and ceramic, wherein: one charging box is able to carry one or more parts; metal nets or metal plates are provided between the parts, and between the parts and the charging box, to separate the parts, and the parts and the charging box; materials comprising rare earth are provided in the charging box;

and then closing a cover of the charging box;

feeding the charging box into a vacuum heat treatment furnace to be processed with vacuum heat treatment; wherein: the vacuum heat treatment furnace carries one charging box or a plurality of charging boxes; and after feeding the charging box into the vacuum heat treatment furnace, evacuating the vacuum heat treatment furnace, heating and heat-preserving the charging box, and then cooling the charging box by inert gas.

2. The method for producing the neodymium-iron-boron rare earth permanent magnetic device, as recited in claim 1, wherein after the alloy is pressed and compacted into compacts in the oriented magnetic field, the compacts are processed with isostatic pressing; before the process of vacuum heat treatment, the parts are processed with oil removing, washing, and drying; and after the process of vacuum heat treatment, the parts are optionally processed with post processes, comprising grinding, chamfering, sandblasting, electroplating, electrophoresis, spraying, and vacuum coating.

3. The method for producing the neodymium-iron-boron rare earth permanent magnetic device, as recited in claim 1, wherein vacuum degree of the vacuum heat treatment is $5\text{-}5\times10^{-4}$ Pa; a temperature of heat preservation is 800-1000° C.; a period of heat preservation is 2-20 hours; the charging box is cooled with argon after heat preservation; then temperature is increased to 450-650° C. after cooling; and after preserving heat for 0.5-12 hours, the charging box is cooled with argon again.

4. The method for producing the neodymium-iron-boron rare earth permanent magnetic device, as recited in claim 1, wherein the rare earth permanent magnetic alloy is smelted with a method of vacuum induction melting; the rare earth permanent magnetic alloy in a molten state is poured on a rotating cooling roller with a water cooling device to be cooled and form an alloy slice; the alloy slice leaves the cooling roller and falls into a rotating cylinder or a turntable; and then the alloy slice is cooled again.

5. The method for producing the neodymium-iron-boron rare earth permanent magnetic device, as recited in claim 1, wherein the hydrogen pulverization refers to that the alloy is fed in a charging basket hung on a transmission device; the charging basket carrying the alloy is transported to a hydrogen adsorption chamber, a heating dehydrogenation chamber and a cooling chamber of a continuous vacuum hydrogen pulverization furnace in turn, in such a manner that the alloy is processed with hydrogen adsorption, heating and dehydrogenation, and cooling in turn; a number of the hydrogen adsorption chamber is one or more; a number of the heating dehydrogenation chamber is one or more; a number of the cooling chamber is one or more; and then the alloy is stored in a storage drum under the condition of vacuum or protective atmosphere.

6. The method for producing the neodymium-iron-boron rare earth permanent magnetic device, as recited in claim 1, the process of milling is finished by a jet mill; powder is collected by a cyclone collector; fine powder having a grain diameter less than 1 μm which is discharged with gas of the cyclone collector is collected by a filter; then the powder and the fine powder are mixed; and a milling chamber of the jet mill has an oxygen content within 50 ppm.

7. The method for producing the neodymium-iron-boron rare earth permanent magnetic device, as recited in claim 1, the process of milling is finished by a jet mill; powder is collected by a cyclone collector; fine powder having a grain diameter less than 1 μm, which is discharged with gas of the cyclone collector, is collected by a fine powder collector; then the powder and the fine powder are mixed; and a milling chamber of the jet mill has an oxygen content within 50 ppm.

8. The method for producing the neodymium-iron-boron rare earth permanent magnetic device, as recited in claim 1, wherein the processes after the hydrogen pulverization and before sintering are under the condition of vacuum or protective atmosphere, and the oxygen content of the atmosphere is less than 200 ppm.

9. The method for producing the neodymium-iron-boron rare earth permanent magnetic device, as recited in claim 1, wherein the compacts are processed with aging treatment after being sintered, and then the compacts are post-processed with the machining and the vacuum heat treatment.

* * * * *